US007197843B2

(12) United States Patent
Oertwig

(10) Patent No.: US 7,197,843 B2
(45) Date of Patent: Apr. 3, 2007

(54) ELECTRONIC IGNITION SYSTEM FOR A FIREARM

(75) Inventor: Terrance D. Oertwig, West Plains, MO (US)

(73) Assignee: OPG Gun Ventures, LLC, West Plains, MO (US)

( * ) Notice: Subject to any disclaimer, the term of this patent is extended or adjusted under 35 U.S.C. 154(b) by 233 days.

(21) Appl. No.: 10/920,807

(22) Filed: Aug. 18, 2004

(65) Prior Publication Data

US 2005/0188872 A1 Sep. 1, 2005

Related U.S. Application Data

(60) Provisional application No. 60/547,450, filed on Feb. 25, 2004.

(51) Int. Cl.
*F41C 9/08* (2006.01)

(52) U.S. Cl. ..... 42/51; 42/84; 89/1.3

(58) Field of Classification Search ..... 42/84, 42/51; 89/1.3
See application file for complete search history.

(56) References Cited

U.S. PATENT DOCUMENTS

| | | | | | |
|---|---|---|---|---|---|
| 3,580,113 | A | * | 5/1971 | Ramsay et al. | 42/84 |
| 3,748,770 | A | * | 7/1973 | Mitchell | 42/84 |
| 3,777,387 | A | * | 12/1973 | Ritchey | 42/84 |
| 3,815,271 | A | | 6/1974 | Lynn | 42/84 |
| 4,078,327 | A | | 3/1978 | Moller et al. | 42/84 |
| 4,109,557 | A | | 8/1978 | Zaucha | 89/7 |
| 4,134,223 | A | | 1/1979 | Hillenbrandt et al. | 42/84 |
| 4,285,153 | A | | 8/1981 | Crouch | 42/84 |
| 4,298,914 | A | | 11/1981 | Long | 89/1.814 |
| 4,709,615 | A | | 12/1987 | Field | 89/1.56 |
| 4,907,487 | A | | 3/1990 | Tidman et al. | 89/8 |
| 5,044,278 | A | * | 9/1991 | Campbell | 102/202.8 |
| 5,074,189 | A | | 12/1991 | Kurtz | 42/50 |
| 5,192,818 | A | * | 3/1993 | Martin | 42/70.01 |
| 5,287,791 | A | | 2/1994 | Chaboki et al. | 89/8 |
| 5,329,840 | A | | 7/1994 | Corney | 89/135 |
| 5,625,972 | A | | 5/1997 | King et al. | 42/84 |
| 5,784,821 | A | | 7/1998 | Gerard | 42/84 |
| 5,937,558 | A | | 8/1999 | Gerard | 42/84 |
| 5,975,888 | A | | 11/1999 | Hsu | 431/255 |
| 6,186,040 | B1 | | 2/2001 | Weise et al. | 89/8 |
| 6,286,241 | B1 | | 9/2001 | Constant et al. | 42/84 |
| 6,354,218 | B1 | | 3/2002 | Weise et al. | 102/286 |
| 6,357,157 | B1 | | 3/2002 | Constant et al. | 42/84 |
| 6,374,525 | B1 | * | 4/2002 | Thomas | 42/51 |
| 6,523,534 | B2 | * | 2/2003 | Juan | 124/32 |
| 6,805,055 | B1 | * | 10/2004 | Jebsen et al. | 102/205 |

OTHER PUBLICATIONS

Remington, "Owner's Manual", Instruction Book for : Models 700ML and 700MLS In-Line Bolt Action, Muzzleloading Rifles, pp. 1-28, no date provided.

* cited by examiner

*Primary Examiner*—Stephen M. Johnson
(74) *Attorney, Agent, or Firm*—Lewis, Rice & Fingersh, L.C.

(57) ABSTRACT

Electronic ignition systems which are designed for use with personal firearms utilizing black powder (or black powder substitutes) such as shotguns, rifles, and pistols. Generally, the firearms will be of the type classified as muzzleloaders. The electronic ignition systems generate an electric arc in the barrel of the firearm which ignites the propellant charge in the firearm discharging it when a firing switch is closed.

22 Claims, 4 Drawing Sheets

ELECTRONIC IGNITION SYSTEM FOR A FIREARM

CROSS REFERENCE TO RELATED APPLICATION(S)

This application claims priority to U.S. Provisional Application Ser. No. 60/547,450 filed Feb. 25, 2004, the entire disclosure of which is herein incorporated by reference.

BACKGROUND OF THE INVENTION (1) Field of the Invention

The present invention pertains to an electronic ignition system which uses an electric arc to ignite the propellant in a personal firearm and a firearm using such a system.

(2) Background of the Invention

Hunting and shooting with muzzleloaders is rapidly gaining popularity as a sport. The muzzleloader is essentially a primitive rifle, shotgun, or pistol, based on designs used during the early days of America and lacking the effective range of more modem center fire rifles and the speed of reloading available to cartridge firearms. Because of their popularity, many states have adopted special muzzleloader seasons for hunting with these weapons to allow sportsmen using them (who generally have to get much closer to their targets and be more sure of their aim than those using modem cartridge rifles) to be able to effectively hunt. With the creation of these special seasons, many hunters are moving from more modem rifles to muzzleloaders to take advantage of the special season.

A muzzleloader is also known as a "black powder" firearm due to their use of a different chemical formulation of gunpowder commonly called black powder (which does not specifically relate to the color). As opposed to a more modem firearm which is loaded with a cartridge at the breach, in a muzzleloader loose powder (or powder pellets) and the projectile are loaded into the barrel via the muzzle of the gun and tamped against the breach plug. The powder used is black powder, or more modem substitutes for black powder such as, but not limited to, Pyrodex™ or Triple 7™ manufactured by the Hodgdon Powder Company. The modem smokeless powder used in cartridges and shotgun shells, however, cannot be safely used with most muzzleloaders.

Black powder firearms currently use one of two systems to ignite the powder charge and discharge the projectile from the firearm. The most primitive type of firearm is a flintlock which utilizes a flint which is thrown forward by the hammer (which is generally mounted on the side of the firearm) into a piece of steel generating a spark. The spark is used to ignite a priming pan of fine black powder. The burning priming powder sends a spark through a touchhole which is a small hole in the side of the firearm's barrel. The spark then ignites the main powder charge in the barrel which discharges the firearm.

More modern black powder firearms are caplocks. The traditional caplock still has the hammer on the side of the gun but the flint, steel, and priming pan are eliminated. Instead the hammer swings into a percussion cap which contains an explosive fulminate of mercury. The percussion cap is resting on a nipple through which the spark travels to reach the main charge in the barrel. The most modem type of muzzleloader was developed to provide more effective discharge. This is an in-line caplock which operates in the same manner as a traditional caplock but instead of having the hammer, nipple, and cap on the side of the gun, they are placed in line with the barrel. The in-line caplock is essentially a modernized muzzleloader which retains the firing and loading profile of a traditional muzzleloader with a more modem ignition system.

By their very nature, muzzleloaders are essentially primitive firearms, and for many hunters and shooters this primitive nature is part of their appeal. The weapon's decreased effective range requires the hunter to be a more effective stalker. Further, the time it takes to reload a muzzleloader generally means that the hunter gets only a single shot at a target requiring them to be sure of their aim before firing. There is also polarization in muzzleloading hunting. Some wish to only utilize traditional firearms and are very interested in the nostalgia (these tend to use flintlocks and sidelocks to "accurately" represent primitive hunting). Others are continuously modernizing the "primitive" firearm to provide for improved triggering, safety, and accuracy, while still keeping the tradition of loading powder and shot down the muzzle instead of using a cartridge to provide for the long reload time and single shot capability. These hunters generally use in-line caplocks and are always interested in improving on the design without altering the basic loading and shooting characteristics of the firearm. Many of these improvements relate to modernized projectiles that provide improved flight characteristics, modem propellants which provide improved propulsion and ignition and the in-line caplock design which provides for surer ignition.

Because the powder, projectile and percussion cap are separately loaded for each shot and are not subject to mechanical assembly as in a cartridge rifle, muzzleloaders are particularly vulnerable to conditions known as hangfire or misfire where the gun does not discharge immediately upon the trigger being pulled. A misfire occurs when the gun does not fire at all. A hangfire occurs when the cap or flint successfully flames and sends sparks toward the main charge, but the main charge does not ignite for a few seconds after the trigger is pulled. A hangfire can be particularly problematic because the action of the hammer may startle the intended target, and the gun may discharge later without the intended target in the field of fire. Further, a hangfire may result in the user positioning the gun unsafely, thinking the gun has misfired, prior to it discharging.

Most of these problems result from imperfect operation of the ignition systems. In a cartridge firearm, the ignition system and primary propellant are both encased in the cartridge which allows them to be in direct contact when the gun is fired. Therefore, hangfires are unlikely. In a muzzleloading firearm, there is always some distance that the flame needs to travel to get from the cap or priming pan to the primary propellant. The travel time of the spark can be undesirably increased if the conditions are wet or if there is powder in the hole which must burn, essentially like a fuse, for the spark to reach the primary propellant.

SUMMARY OF THE INVENTION

Because of these and other problems in the art, described herein, among other things, are electronic ignition systems which are designed for use with personal firearms utilizing black powder (or black powder substitutes) such as shotguns, rifles, and pistols. The terms black powder firearm and muzzleloader are used interchangeably in this disclosure to refer to firearms of the same general type. In particular, to firearms where the propellant charge is not encased in a cartridge with the projectile and ignition material, but where the principal propellant is in contact with the barrel of the firearm.

The electronic ignition systems discussed herein generally provide for a more predictable and reliable ignition of the primary propellant charge in the firearm when the firearm is triggered which helps to improve safety and reliability of the firearm compared to a similar firearm utilizing a propellant cap. At the same time, the electronic ignition systems described herein do not alter the ballistics of the projectile or dramatically accelerate the reloading time of the firearm. In this way, a black powder hunter can be more certain that his firearm will both discharge safely and discharge when triggered, even in inclement weather, without having to give up the characteristics of a black powder firearm that many hunters particularly seek out.

Described herein, in an embodiment is an electronic ignition system for a firearm, the system comprising: an electrode, the electrode being capable of producing an electric arc; a battery electrically connected to said electrode for providing electricity to said electrode; and a firing switch electrically connected between said battery and said electrode such that when said firing switch is closed said electricity from said battery produces an electric arc from said electrode; wherein said electrode is sized and shaped so that said electric arc contacts a propellant charge in said firearm igniting said propellant charge.

In an embodiment of the electronic ignition system, the system further comprises a capacitor, said capacitor placed between said battery and said firing switch such that said capacitor is charged by said battery and discharges when said firing switch is closed; an arming switch electrically connected between said capacitor and said battery wherein said capacitor cannot charge when said arming switch is open, a safety switch electrically connected between said capacitor and said firing switch wherein said electric arc cannot be generated unless both said firing switch and said safety switch are closed, and an indicator electrically connected to said capacitor, said indicator indicating when said capacitor is charged. This may be retrofitted into an existing personal firearm or originally manufactured into a new personal firearm.

In an embodiment of the electronic ignition system, the firearm is one of: a rifle, a shotgun, or a pistol. In another embodiment, the electric arc may generated between said electrode and a second electrode, or if there is a breach plug supporting the electrode, between said electrode and said breach plug.

In another embodiment, there is described herein, a firearm comprising a barrel; a breach plug; at least two electrodes in said breach plug; a source of electricity electrically connected to said at least two electrodes; and a firing switch electrically connected between said at least two electrodes and said source of electricity such that when said firing switch is closed, an electric arc is created between said at least two electrodes, said electric arc being inside said barrel.

In an embodiment of the firearm, the firearm also comprises a capacitor, said capacitor electrically connected between said source of electricity and said firing switch such that said capacitor is charged by said source of electricity and discharges when said firing switch is closed, an arming switch electrically connected between said capacitor and said source of electricity wherein said capacitor cannot charge when said arming switch is open, a safety switch electrically connected between said capacitor and said firing switch wherein said electric arc cannot be generated unless both said firing switch and said safety switch are closed, and an indicator electrically connected to said capacitor, said indicator indicating when said capacitor is charged.

In another embodiment of the firearm, the firearm further comprises a propellant charge and projectile within said barrel wherein said electric arc ignites said propellant charge and the explosion of said propellant charge expels said projectile from said barrel.

In still another embodiment of the firearm, the firearm is a muzzleloader, a rifle, a shotgun, a pistol In a yet further embodiment, there is described herein, a firearm comprising: a barrel; means for producing an electric arc in said barrel; and switching means electrically connected to said means for producing said electric arc such that when said switching means is switched from a first state to a second state said electric arc is generated in said barrel.

DETAILED DESCRIPTION OF THE PREFERRED EMBODIMENTS

The embodiments of the invention discussed herein are principally shaped and designed for use to replace the firing mechanism of a modem in-line caplock muzzleloading rifle. However, one of ordinary skill in the art would understand how the electronic ignition systems discussed herein can be used to replace the firing system on a sidelock or flintlock simply by reshaping components. Further, while the ignition system is also principally discussed herein for use on a rifle, the ignition system can be used on a shotgun, pistol, or any other style of personal black powder firearm without undue experimentation. Still further, while the systems discussed herein are discussed to be retrofitted into an existing in-line caplock rifle replacing the in-line caplock mechanism, this is done simply to show comparison to existing systems and the ignition system will often be built into an originally constructed black powder firearm providing a completely new class of black powder firearm.

Figure 1:
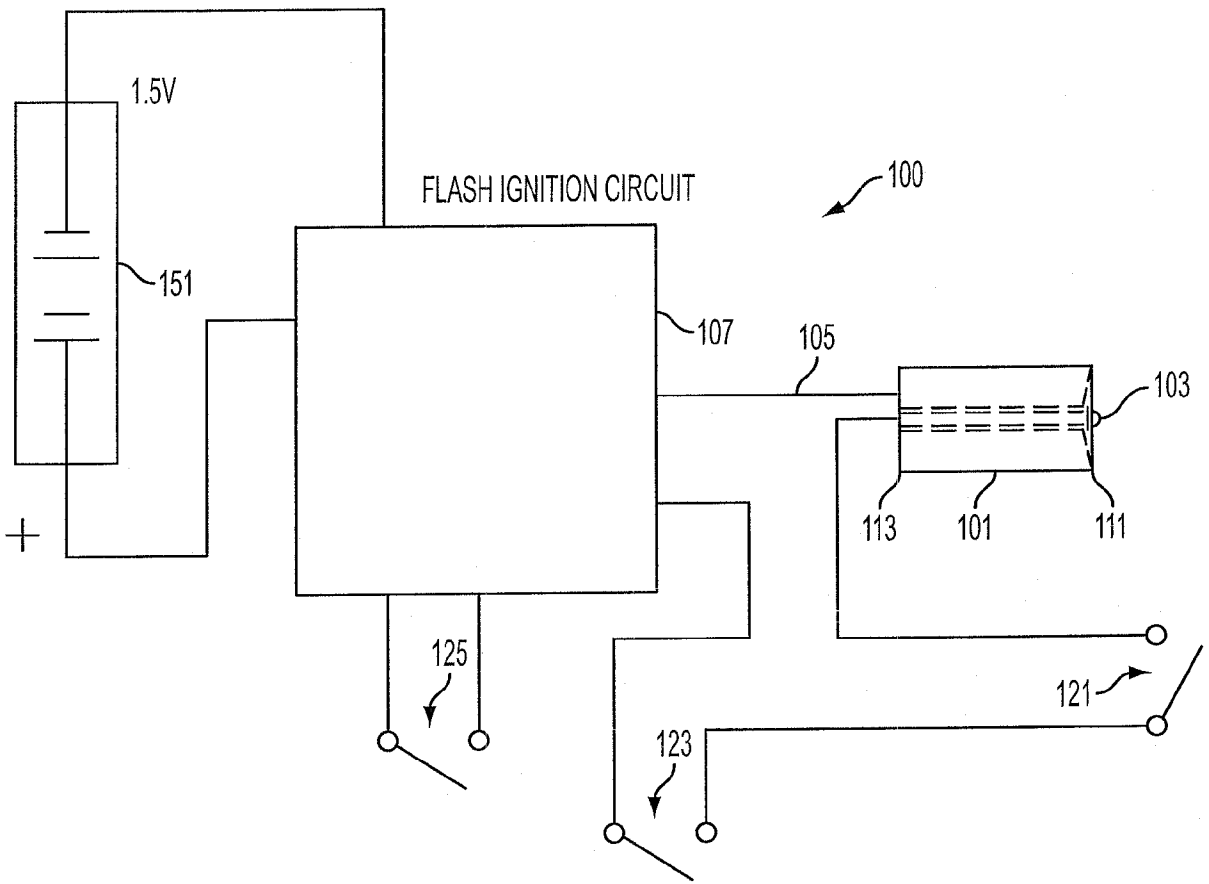
FIG. 1 Provides a block electrical diagram of an embodiment of an electronic ignition system.
Figure 4:
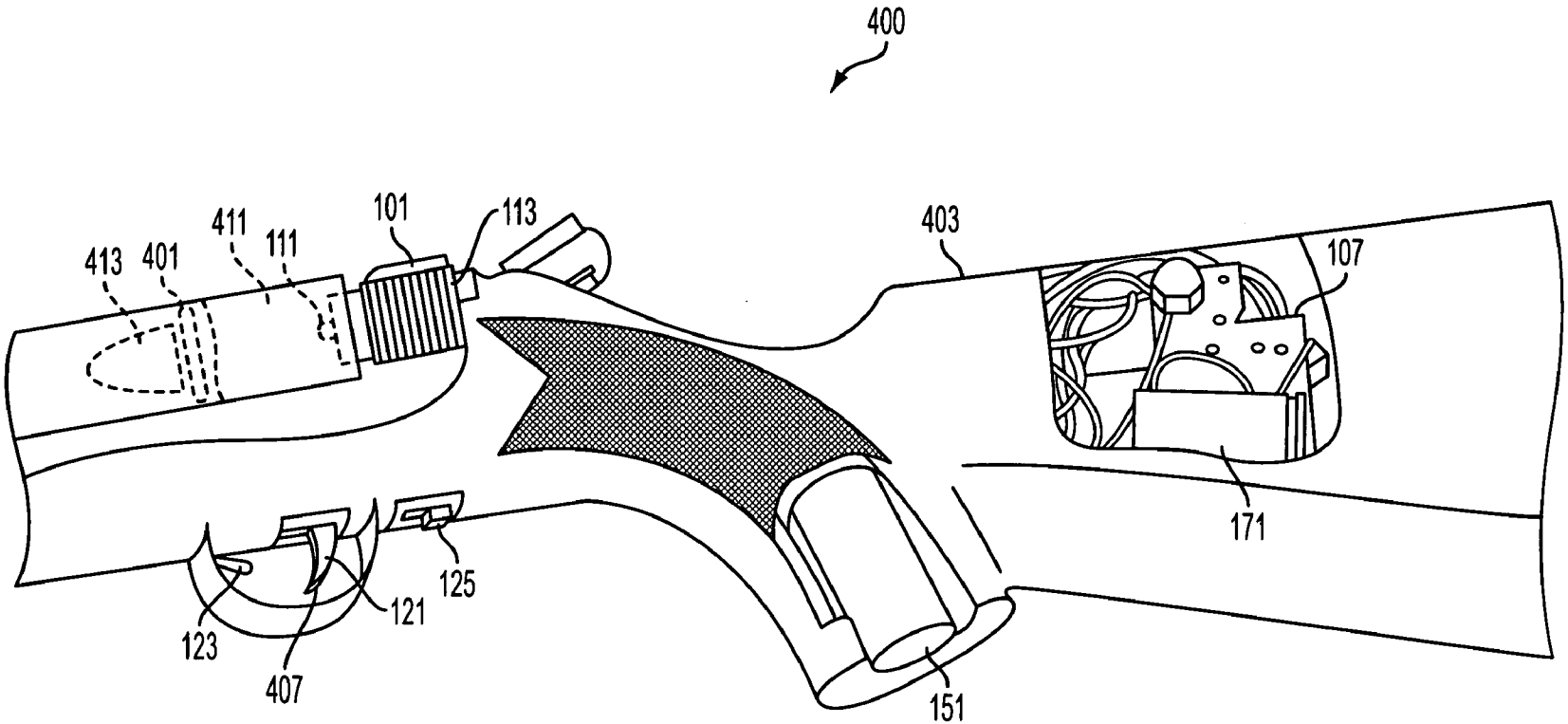
FIG. 4 shows a portion of a firearm including an embodiment of an ignition system.

FIG. 1 provides a diagram of a first embodiment of an electronic ignition system (100) separated from a firearm. In FIG. 1 there is shown a breach plug (101) including a positive electrode (103) therein. The electrode (103) is a wire or similar component arranged so that at least a portion of the electrode (103) is unshielded and extends from the front end (111) of the breach plug (101). Electricity may, therefore, pass from the electrode to material in contact with the electrode. Generally, electrical discharge from the electrode (103) will be an electric arc generated between the electrode (103) to the breach plug (101) which acts as an opposing electrode. The breach plug (101) will be used to replace the existing breach plug on a muzzleloading firearm of the type known to the prior art with the front end (111) placed toward the barrel (401) of the firearm, as shown in FIG. 4, and the rear end (113) placed toward the stock (403) or handle of the firearm. The electrode (103) is electrically connected to wiring (105) toward the rear end (113) of the breach plug (101). The wiring (105) will preferably be insulated so as to decrease the risk of electric shock or short in the system (100). The breach plug (101) is preferably made of metal and can act as a ground for the electrode (103).

Figure 3:
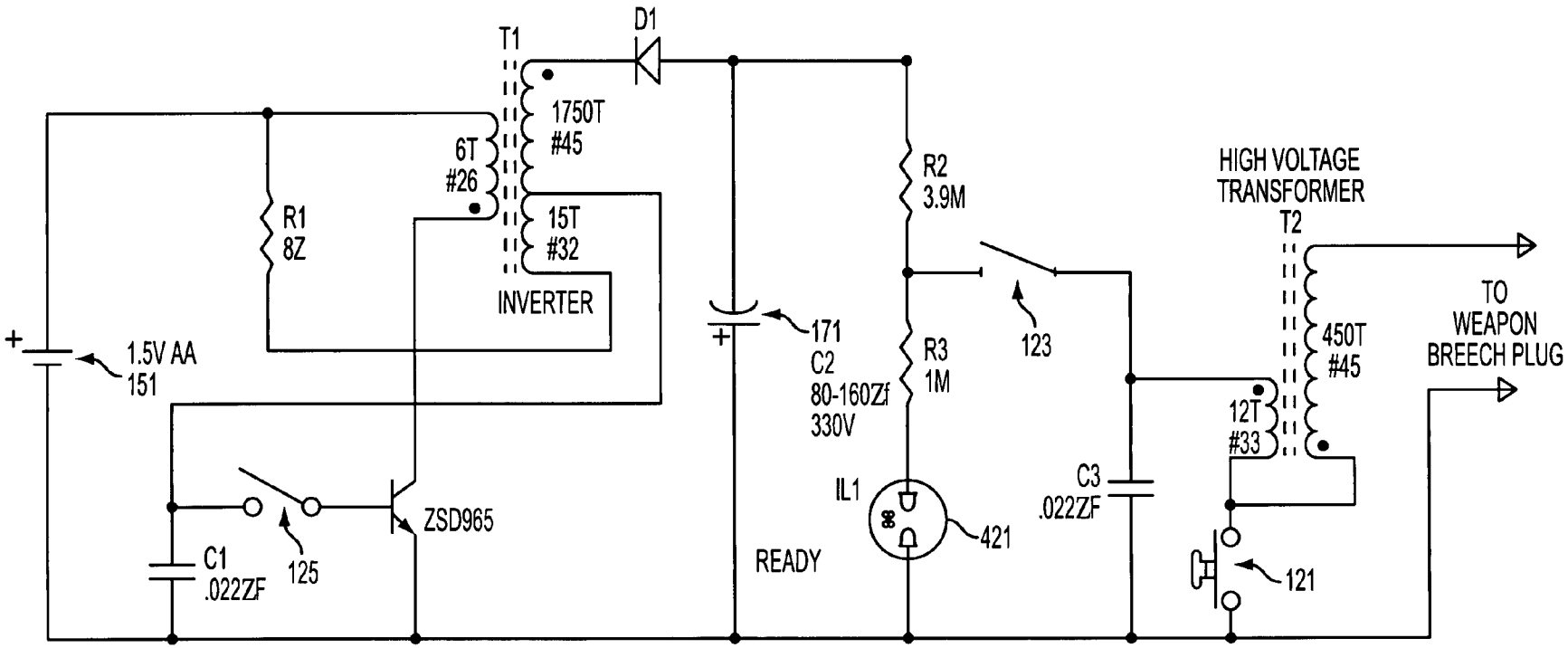
FIG. 3 Provides an electrical diagram of an embodiment of a flash circuit.

The wiring (105) is in turn connected to a Printed Circuit Board (PCB) or other circuit arrangement which comprises a flash circuit (107). An embodiment of a flash circuit (107) which may be used is included as FIG. 3 and discussed later. The flash circuit (107) will generally be a circuit to allow discharge of a capacitor (171) included within the flash circuit (107). While a particular flash circuit (107) is shown in the FIGS., one of ordinary skill in the art would recognize that this circuit is merely exemplary. For this reason only the most basic function of the circuit will be discussed. In an embodiment, the flash circuit (107) may be similarly arranged as those used to trigger electronic flashbulbs in cameras.

Attached in a manner to provide power to the flash circuit (107) is a source of electricity such as, but not limited to, a battery (151). The battery (151) is preferably a standard 1.5 volt alkaline or rechargeable (nickel-cadmium) battery preferably of a smaller size such as those classified as AA or AAA or used as photo batteries. However, any sized battery of any voltage and amperage could be used as would be understood by one of ordinary skill in the art to drive an appropriately laid out flash circuit. The battery (151) will serve to power up the capacitor (171) in the flash circuit (107) when the arming switch (125) is closed.

The electronic ignition system of FIG. 1 may be used to replace the caplock mechanism of an existing in-line caplock firearm in the following manner as shown in FIG. 4. The caplock firing mechanism may be removed from the firearm by removing the existing bolt, hammer system/firing pin, nipple, and breach plug. The breach plug of the caplock is then replaced with the breach plug (101) with the electrode (103) projecting into the barrel (401) of the firearm (400). The wiring (105), flash circuit (107), and battery (151) may then be placed into the space the bolt was removed from. Some or all of the bolt assembly (405) may be used to cover the electronic ignition system (100) to protect it from the elements depending on the construction of the device, or a new cover may be installed to protect the system (100) or any portion of the system. The safety switch (123) may be wired in a manner to allow the existing safety in the firearm (400) to be used to open and close the safety switch (123) and the firing switch (121) may be wired to the existing trigger (407) to allow the trigger (407) to be used to close the firing switch (121) in the traditional manner of most firearms. The arming switch (125) may be placed anywhere to make it accessible to the user and will generally be provided in a custom location in the breech area or in the stock.

Figure 2:
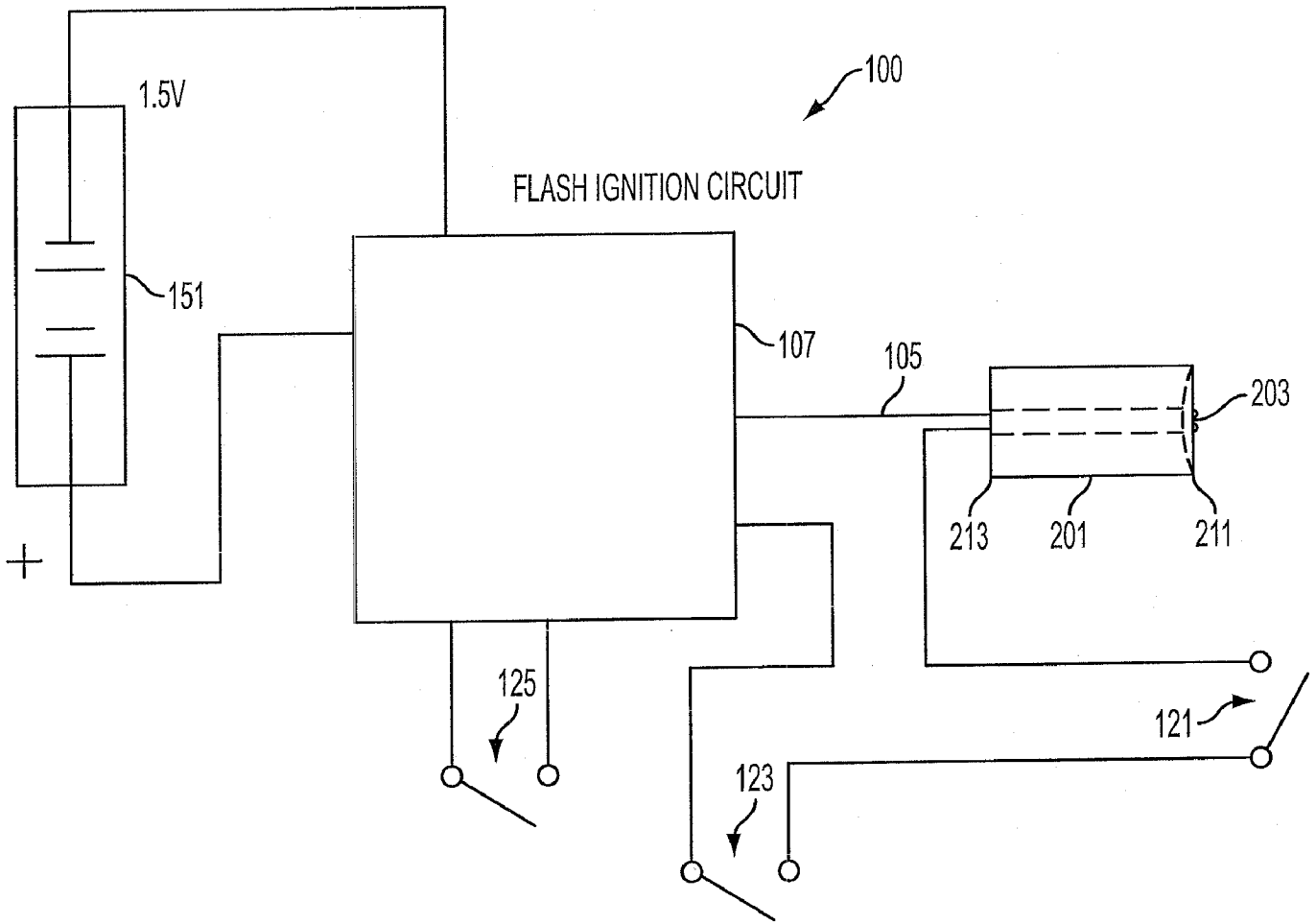
FIG. 2 Provides a block electrical diagram of another embodiment of an electronic ignition system.

The embodiment of FIG. 2 is essentially the same as that of FIG. 1, however instead of using a positive electrode (103) with a ground in the breach plug (101) whereby the electric arc therebetween triggers the propellant charge, the breach plug (201) includes both a positive and a negative electrode (203) closely spaced and both of which extend from the front (211) of the breach plug (201). When the capacitor (171) is discharged, the electrodes (203) will produce an electrical arc across the air gap between them which triggers the main propellant charge.

As touched on above, the electronic ignition system (100) of either embodiment includes numerous features to help improve safety. The clearest is in the reliability of discharge. The main propellant charge (411), when loaded, will be preferably placed in contact with the electrode (103) or (203), therefore there is no need for a spark to be transferred through a nipple or flashhole.

In particular the main propellant (411), when loaded in the barrel (401) of the firearm (400) will rest, at least partially on the breach plug (101) and will lie immediately adjacent to, or within, the air gap through which the electric arc will pass. Alternatively, a shaped powder charge may be used placing the propellant in a similar arrangement. The electrical "spark" generated by the arcing electrodes is preferably in direct contact with the main propellant charge (411) when generated. Because there is no need for the transfer of a spark to the main propellant charge (411) as it is generated in sufficiently close proximity to not require transfer, there is a decreased risk of hangfire due to there being a small amount of powder in the hole that acts as a fuse, or the spark being otherwise delayed on its way to the propellant charge (411). This generally decreases the risk of a hangfire situation and makes the firing of the weapon more sure.

The electric arc ignition also is preferable for use in inclement weather. In inclement weather conditions, particularly damp conditions, traditional black powder firearms are generally more prone to hangfires or misfires as the traveling spark can be extinguished or have problems traveling. In an electric arc ignition system, the entire structure may be protected from the elements by being internal to the firearm. This will protect it from the weather conditions. Further, with appropriate insulation, protection, and design, electric systems may be shielded from the elements to provide for reliable discharge and arc generation which results in both more reliable and safer firing characteristics.

There are also included three switches in the electric firing system (100) to act as safety switches and help prevent unintended discharge of the firearm (400) which are generally more effective than traditional mechanical safeties. Firstly, there is included an arming switch (125). The arming switch (125) is electrically connected in the system to serve to prevent the capacitor (171) from charging from the battery (151) until the user of the firearm (400) arms the firearm (400). In this way, when the firearm (400) is not armed it is highly unlikely that the ignition system (100) will accidentally discharge the firearm (400) as the capacitor (171) lacks the necessary charge to send an electrical current of sufficient strength to the electrode (103) or (203) to create the electric arc.

In a preferred embodiment, the arming switch (125) and capacitor (171) may be connected to an LCD light or similar indicator (421) that indicates when the capacitor (171) is fully charged. In this way the user of the firearm (400) can load the firearm (400) with the ignition system (100) disarmed to decrease the danger of the firearm (400) discharging during loading. Also in a preferred embodiment, the arming switch (125) will automatically open after discharge of the firearm (400) (or triggering of the electronic ignition system (100) even if the firearm (400) hangfires or misfires). In this way, when the capacitor (171) discharges, it will not be able to recharge prior to the user rearming the ignition system (100).

If the arming switch (125) is open, but the capacitor (171) has already been charged there is still a possibility of the firearm (400) discharging as the capacitor (171) still has sufficient charge to generate the electric arc as it takes time for the capacitor (171) to slowly discharge. By opening the arming switch (125) when the capacitor (171) is discharged, the capacitor (171) has no chance to recharge until the arming switch (125) is purposefully reengaged.

In another embodiment, there is also included a further system for safely discharging the capacitor (171) bypassing the electrode (103), so that the user may discharge the capacitor (171) without generating an arc from the electrode (103) or discharging the firearm (400), even if the firearm (400) is loaded. The arming switch (125) effectively acts to safe the firearm (400) and prevent discharge by eliminating the ability of the ignition system (100) to ignite the main propellant (411). In this way, the firearm (400) may be safely carried even while loaded.

There are also two more switches included in the ignition system (100). The safety switch (123) acts similarly to a mechanical safety for a firearm. As the safety switch (123) is in the path between the electrode (103) and the capacitor (171), if the safety switch (123) is open, the flash circuit (107) is designed not to discharge through the electrode (103). The safety switch (123) therefore acts to protect against accidental discharge of the firearm (400) once the flash circuit (107) has been armed. The use of a safety switch (123) is preferred, but by no means required, and the safety switch (123) acts in many ways like, and may even be connected to, the existing safety switch (123) of a muzzle-loading firearm.

The final switch is the firing switch (121). The firing switch (121) closes the flash circuit (107) and if all works correctly and if the safety switch (123) is closed and the capacitor (171) charged, generates the electrical arc, ignites the main propellant (411), and discharges the firearm (400) expelling a projectile (413) at the target. The firing switch (121) is effectively the firearm's (400) trigger (407). Depending on the preference of the user, the firing switch (121) maybe linked to a mechanical trigger of the type known to those of ordinary skill in the art, or may replace the trigger with a electronic switch. The firing switch (121) will preferably be a type of switch that will default to an open position whereby the user must hold the firing switch (121) closed to place it in the closed position.

It would be apparent to one of ordinary skill in the art, that the use of an electronic switch to either replace or supplement the existing mechanical trigger has particular advantages. It is well known in shooting that one of the difficulties in shooting a firearm accurately is that pulling the trigger requires a particular amount of force and applying that force can cause the firearm to be moved off target. In the black powder case, due to the necessarily inaccurate nature of the firearm and its single shot capability, such a movement is more likely to result in a wide shot. For safety reasons, it is almost always safer to have the projectile hit the target so easier controlled discharge of the firearm is generally an improvement.

Because the firing switch (121) is electronic, even if a traditional trigger is used, the trigger can require little to no strength to activate which can help to eliminate inaccuracy due to trigger pull strength. Further, the mechanical trigger can be replaced with a purely electrical switch which can provide further benefits. For instance, the electrical switch can incorporate computer chips, scanners or similar devices to determine, before triggering the firearm (400), that the user is the owner of the firearm (400) (such as by, but not limited to, scanning a fingerprint from the surface of the switch). The firing switch (121) can also be customized for the application. For instance, in a hunting situation, the firing switch (121) may be placed in a manner to allow for triggering without noise so in the unlikely event of a misfire, the target is not spooked by the firing mechanism being activated. The firing switch (121) may also be able to supply different amounts of pull depending on the need of the user and may be switchable. For instance, the user may be able to set the trigger to a very high pull strength when transporting the firearm (400) and approaching the target, but lower the pull strength once the hunter is ready to fire. Used in conjunction with the safety switch (123) and/or arming switch, this can make it very difficult to accidentally discharge the firearm (400). The amount of pull strength may be based on a force feedback or other electronic or electromagnetic resistance device which may be controlled by a dial or similar control (not shown) by the user of the firearm (400).

Use of the electronic ignition system (100) is generally as follows. The user will begin by loading the firearm (400). At this time the arming switch (125), safety switch (123), and firing switch (121) will all preferably be open, and the capacitor (171) will preferably be discharged. The user may verify capacitor (171) discharge by determining that the armed indicator (421) indicates that capacitor (171) is not charged. If there is an indication that the capacitor (171) is charged, the user should either safely discharge the capacitor (171) by dry firing the firearm (400) (firing with no propellant or projectile in a safe direction and into a safe backstop), waiting for the capacitor (171) to discharge over time or using a safe discharge mechanism bypassing the electrode (103) if the firearm (400) is provided with such a mechanism. After verifying that the weapon is not armed, the user will load the main propellant (411) into the barrel (401) of the firearm (400), seating the propellant (411) in contact with or in close proximity to the electrode (101) or (201). With loose grain powder, this can result from simply pouring the powder into the barrel (401) in the standard fashion onto the electrodes (101) or (201). If a powder plug, or other pre-constructed powder object is used, the system may require a particular shape of plug to insure contact or proximity which may be constructed to be used with the firearm (400) and ignition system (100). The projectile (413) is then loaded as normal onto the propellant (411). Any type of propellant or projectile, known now or later discovered, which can be ignited by an electric arc and safely discharge the firearm may be used as the propellant (411) and projectile (413) as understood by those of ordinary skill in the art.

Once loaded, the user will prepare to shoot. It is preferred, but not required, that the user not arm the firearm until he is ready to take his shot. However, the user may arm the firearm (400) before being ready to shoot in an alternative embodiment. The firearm (400) is only considered to be "safe," once loaded with propellant (411) and projectile (413), when the capacitor (171) is discharged and the arming switch (125) is open.

When the user is ready to discharge the firearm (400), he will first arm the firearm (400) by closing the arming switch (125). At this time, the capacitor (171) will charge from the battery (151) and, once charged, will so indicate by the armed indicator (421). The user can then set their desired trigger pull weight if such functionality is included. The user will then close the safety switch (123) readying the firearm (400) to fire. They will then fire the firearm (400) by closing the firing switch (121) either by pulling trigger (407) to close the firing switch (121), or by triggering any other mechanism. When the final switch (the firing switch (121)) is closed, the capacitor (171) will release its charge to the electrode (103) or (203) generating an electric arc. The arc will ignite the primary propellant charge (411) whose explosion in turn ejects the projectile (413) from the barrel (401). Upon capacitor (171) discharge, the user will release the firing switch (121) allowing it to open. However, even if the firing switch (121) is held down after firing, the firearm (400) will preferably not discharge again as it has not yet been loaded. Further, even if the arming switch (125) remains closed while the firing switch (121) is closed, the capacitor (171) will generally not recharge as the electricity will flow into the electrode and safely ground.

The arming switch (125) will preferably automatically open upon firing of the firearm (400) or the generation of the electric arc. Opening of the arming switch (125) may occur upon the closing of the firing switch (121) as the firearm (400) will fire so long as the capacitor (171) is charged and the safety switch (123) and firing switch (121) are both closed, even if the arming switch (125) is open. Alternatively, the arming switch (125) may upon opening of the firing switch (121), or when any other event occurs. The safety switch (123) may also automatically open in a preferred embodiment upon firing of the firearm (400). The user will then wait to make sure there is no residual burning of propellant (411) in the barrel (401) and that all switches (121), (123), and (125) are open. They may also alter the pull or type of the trigger mechanism if such functionality is provided. The user can then repeat the above steps to prepare the weapon to fire again.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A muzzleloading firearm comprising:

a barrel;

a breach plug;

at least two electrodes in said breach plug, a source of electricity electrically connected to said at least two electrodes;

a main propellant charge within said barrel;

a projectile within said barrel; and a firing switch electrically connected between said at least two electrodes and said source of electricity such that when said firing switch is closed, an electric arc is created between said at least two electrodes, said electric arc being inside said barrel;

wherein said main propellant charge and said projectile are separately loaded into said barrel; and wherein said electric arc directly ignites said main propellant charge and the explosion of said main propellant charge expels said projectile from said barrel.

2. The firearm of claim 1 further comprising a capacitor, said capacitor electrically connected between said source of electricity and said firing switch such that said capacitor is charged by said source of electricity and discharges when said firing switch is closed.

3. The firearm of claim 2 further comprising an arming switch electrically connected between said capacitor and said source of electricity wherein said capacitor cannot charge when said arming switch is open.

4. The firearm of claim 3 further comprising a safety switch electrically connected between said capacitor and said firing switch wherein said electric arc cannot be generated unless both said firing switch and said safety switch are closed.

5. The firearm of claim 3 further comprising an indicator electrically connected to said capacitor, said indicator indicating when said capacitor is charged.

6. The firearm of claim 1 wherein said firearm is a rifle.

7. The firearm of claim 1 wherein said firearm is a shotgun.

8. The firearm of claim 1 wherein said firearm is a pistol.

9. The firearm of claim 1 wherein said source of electricity comprises a battery.

10. The firearm of claim 9 wherein said battery comprises a 1.5 volt battery.

11. An electronic ignition system for a muzzleloading firearm, the system comprising:

two electrodes in a breach plug, a source of electricity electrically connected to said at least two electrodes; and a firing switch electrically connected between said at least two electrodes and said source or electricity;

wherein a main propellant charge and a projectile are loaded into a barrel of said muzzleloading firearm and said main propellant charge is in contact with said barrel; and wherein, when said firing switch is closed, an electric arc is created between said two electrodes said electric arc directly igniting said main propellant charge and the explosion of said main propellant charge expelling said projectile from said firearm.

12. The system of claim 11 further comprising a capacitor, said capacitor placed between said source of electricity and said firing switch such that said capacitor is charged by said battery and discharges when said firing switch is closed.

13. The system of claim 12 further comprising an arming switch electrically connected between said capacitor and said source of electricity wherein said capacitor cannot charge when said arming switch is open.

14. The system of claim 13 further comprising a safety switch electrically connected between said capacitor and said firing switch wherein said electric arc cannot be generated unless both said firing switch and said safety switch are closed.

15. The system of claim 14 further comprising an indicator electrically connected to said capacitor, said indicator indicating when said capacitor is charged.

16. The system of claim 15 wherein said system is retrofitted into an existing personal firearm.

17. The system of claim 15 which is originally manufactured into a new personal firearm.

18. The system of claim 11 wherein said firearm is a rifle.

19. The system of claim 11 wherein said firearm is a shotgun.

20. The system of claim 11 wherein said firearm is a pistol.

21. The system of claim 11 wherein said source of electricity comprises a battery.

22. The system of claim 21 wherein said battery comprises a 1.5 volt battery.

* * * * *